United States Patent [19]

Houghton

[11] Patent Number: 5,020,260

[45] Date of Patent: Jun. 4, 1991

[54] TAKE-DOWN RIFLE

[75] Inventor: Thomas M. Houghton, Prescott, Ariz.

[73] Assignee: H-S Precision, Inc., Rapid City, S. Dak.

[21] Appl. No.: 458,777

[22] Filed: Dec. 29, 1989

[51] Int. Cl.[5] ..... F41A 11/00; F41A 21/48

[52] U.S. Cl. ..... 42/75.02; 42/75.01

[58] Field of Search ..... 42/75.02, 75.01

[56] References Cited

U.S. PATENT DOCUMENTS

| | | | |
|---|---|---|---|
| 529,455 | 11/1894 | Marlin | 42/75.02 |
| 534,691 | 2/1895 | Hepburn | 42/75.02 |
| 605,111 | 6/1898 | Mason | 42/75.02 |
| 605,734 | 6/1898 | Mason | 42/75.02 |
| 616,719 | 12/1898 | Mason | 200/196 |
| 755,660 | 3/1904 | Hepburn | 42/75.02 |
| 855,181 | 5/1907 | Johnson | 42/75.02 |
| 1,065,341 | 6/1913 | Browning | 42/75.02 |
| 1,370,836 | 3/1921 | Nelson | 42/75.02 |
| 2,789,478 | 4/1957 | McColl | 42/75.02 |
| 3,877,167 | 4/1975 | Keppeler | 42/75.02 |
| 4,310,982 | 1/1982 | Kast et al. | 42/75.02 |
| 4,402,152 | 9/1983 | Casull | 42/75.02 |

*Primary Examiner*—David H. Brown

*Attorney, Agent, or Firm*—Richard G. Harrer; Charles E. Cates

[57] ABSTRACT

A take-down rifle which permits easy removal and reassembly of the barrel to the receiver portion of the rifle and incorporating a system for effectively accommodating for wear in the mating parts thus providing for proper alignment between the rifle's two main components. The system includes a barrel bracket secured to the forearm, an adjustable collar threaded on the receiver end of the barrel and in contact with the barrel bracket, and the bonding of the barrel to the forearm by means of a low durometer elastomeric adhesive. Adjustment for wear can be made by turning the adjusting collar in a direction to cause the barrel to move in a direction away from the barrel bracket which accommodates for any thread wear between the receiver and the barrel.

13 Claims, 2 Drawing Sheets

TAKE-DOWN RIFLE

FIELD OF THE INVENTION

This invention relates to rifles and more particularly to take-down rifles of exceptional accuracy.

BACKGROUND OF THE INVENTION

So-called take-down rifles have been available for many years. The term "take-down rifle" describes a rifle in which the barrel and forearm are readily connected with and detached from stock and receiver frame so as to permit the rifle to be more easily packed. During World War II, the Japanese developed such a rifle for issue to airborne units. A standard bolt action rifle was modified to accommodate a special barrel with interrupted threads at its chamber end that mated with threads on a sleeve provided at the front end of the receiver. Such a rifle proved to be unsuccessful. Thereafter, another version was developed which featured a barrel locked in place by means of a tapered wedge but its accuracy at best was mediocre.

Rifles utilizing a take-down feature are shown in U.S. Pat. Nos. 529,455; 534,691; 605,111; 605,734; 616,719; 755,660; 855,181; 1,065,341 and 1,370,836. In spite of numerous developments in the art of take-down rifles, virtually all such rifles suffer from the inability to hold zero, or repeat the point of aim after the barrel has been removed and reinstalled. Although deviation is probably acceptable for 50 yard plinking rifles, it is not acceptable for long range precision shooting such as may be required for target use or sniper use by the military and law enforcement organizations. In order to obtain the degree of accuracy considered acceptable for sniper or target shooting, all components of any rifle and particularly a take-down rifle must fit together in an extremely tight manner with very close tolerances. Without the means to compensate for wear in mating parts, particularly threadwear, any rifle that is constantly taken apart and reassembled will lose its accuracy resulting in a change in point of impact of the bullet. Consequently, there is a need to provide a take-down rifle that can be taken apart repeatedly and reassembled with provision for maintaining its accuracy.

SUMMARY OF THE INVENTION

Based on the prior art construction of take-down rifles, there then exists a need for means in a take-down rifle which will not only allow for easy removal and reassembly of the barrel to the rifle, but will effectively accommodate for wear in mating parts and particularly thread wear and provide for a perfect or near perfect alignment between the rifle's two main components.

Accordingly, I have invented a system for accommodating such wear. The system includes the use of an adjustable collar which is threaded on and surrounds the barrel at the receiver end of the barrel; the mounting of the barrel to the forearm in such a way that the barrel, although permanently secured to the forearm, is able through operation of the adjustable collar to move a slight distance with respect to the forearm; and provision in the forearm of a special reinforcing member. In a preferred embodiment the barrel is not mounted to the forearm by screws or other types of mechanical fasteners, but is bonded to the forearm by means of a special adhesive, preferably a low durometer elastomeric adhesive. Additionally, and in a preferred embodiment the forearm is made of a non-wood material such as hybrid composites incorporating synthetic fibers of Kevlar, unidirectional graphite, and fiberglass or structural polyurethane foams and utilizing epoxy or polyester based resins as the bonding agents with the reinforcing member incorporated into the forearm to which other mechanical parts of the rifle, such as a barrel bracket are attached.

DETAILED DESCRIPTION OF THE INVENTION

Figure 1:
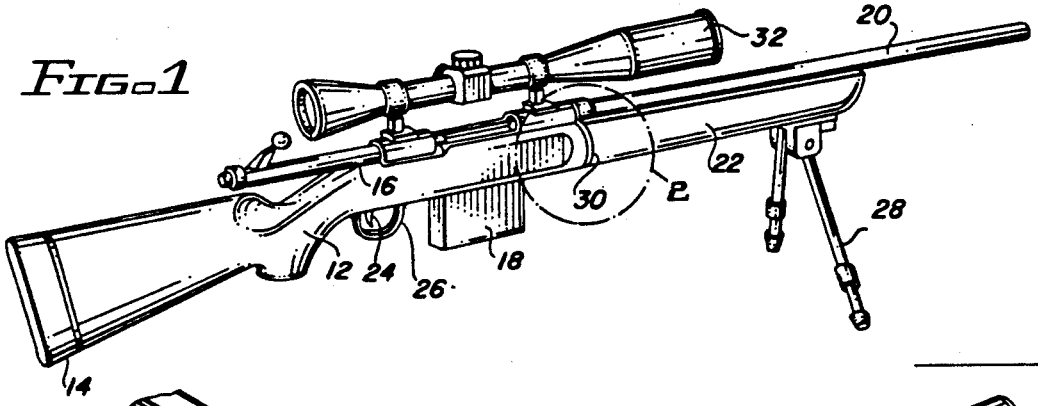
FIG. 1 is a perspective view of a bolt action take-down rifle.

FIG. 1 is a perspective view of a take-down bolt action rifle 10 which incorporates the unique system for mating the take-down barrel with the receiver. As shown, the rifle includes a stock 12 with an adjustable butt plate 14, forearm 22, barrel 20, bolt action receiver 16, detachable box magazine 18, and scope 32 which is appropriately mounted to the receiver by scope mounts 34. The rifle is of course provided with trigger 24 and trigger guard 26. Optionally, the rifle as shown is fitted with a bipod mounted at the front end of the forearm. The area of the rifle where the barrel end and receiver end mate is designated 30.

Figure 2:
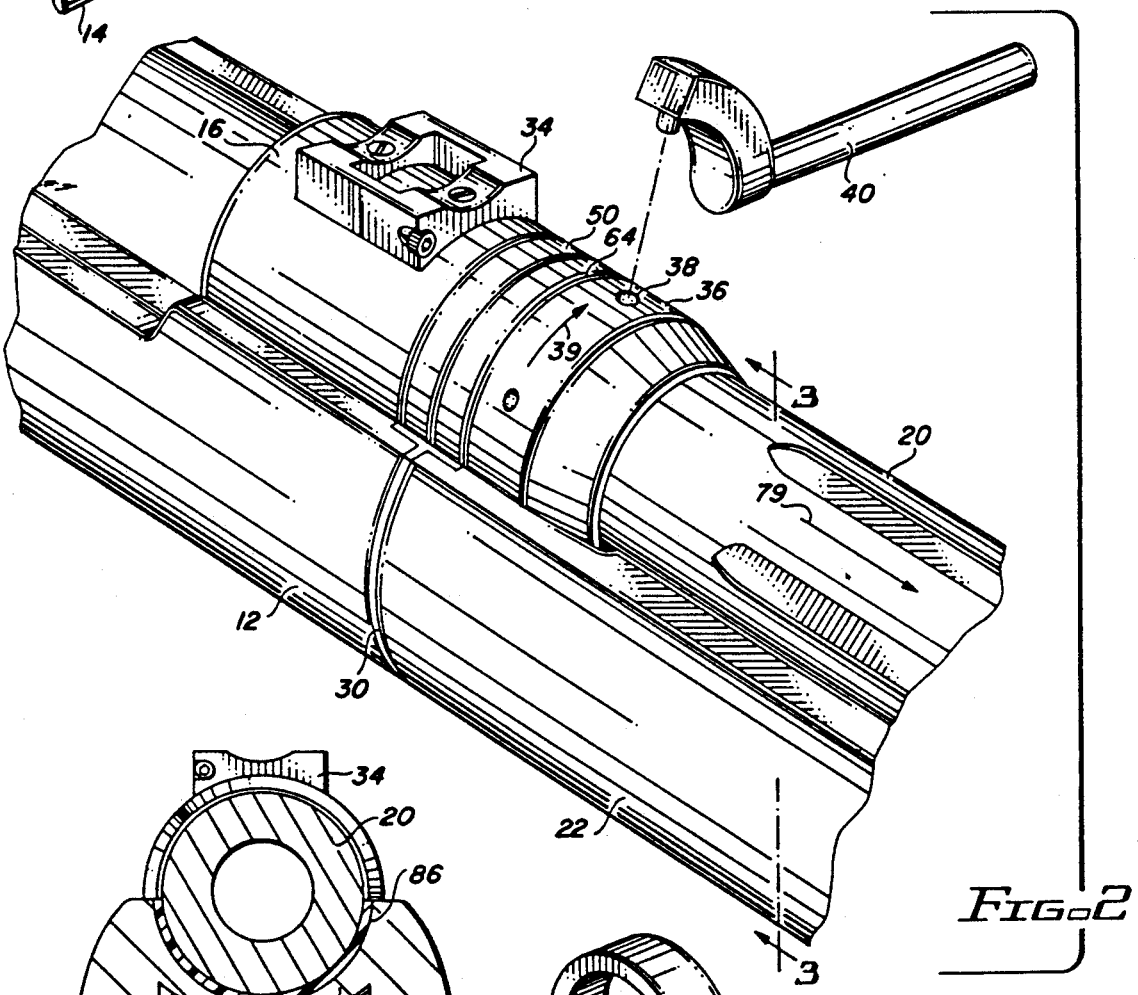
FIG. 2 is an enlarged perspective view of the area designated "2" of FIG. 1.
Figure 4:
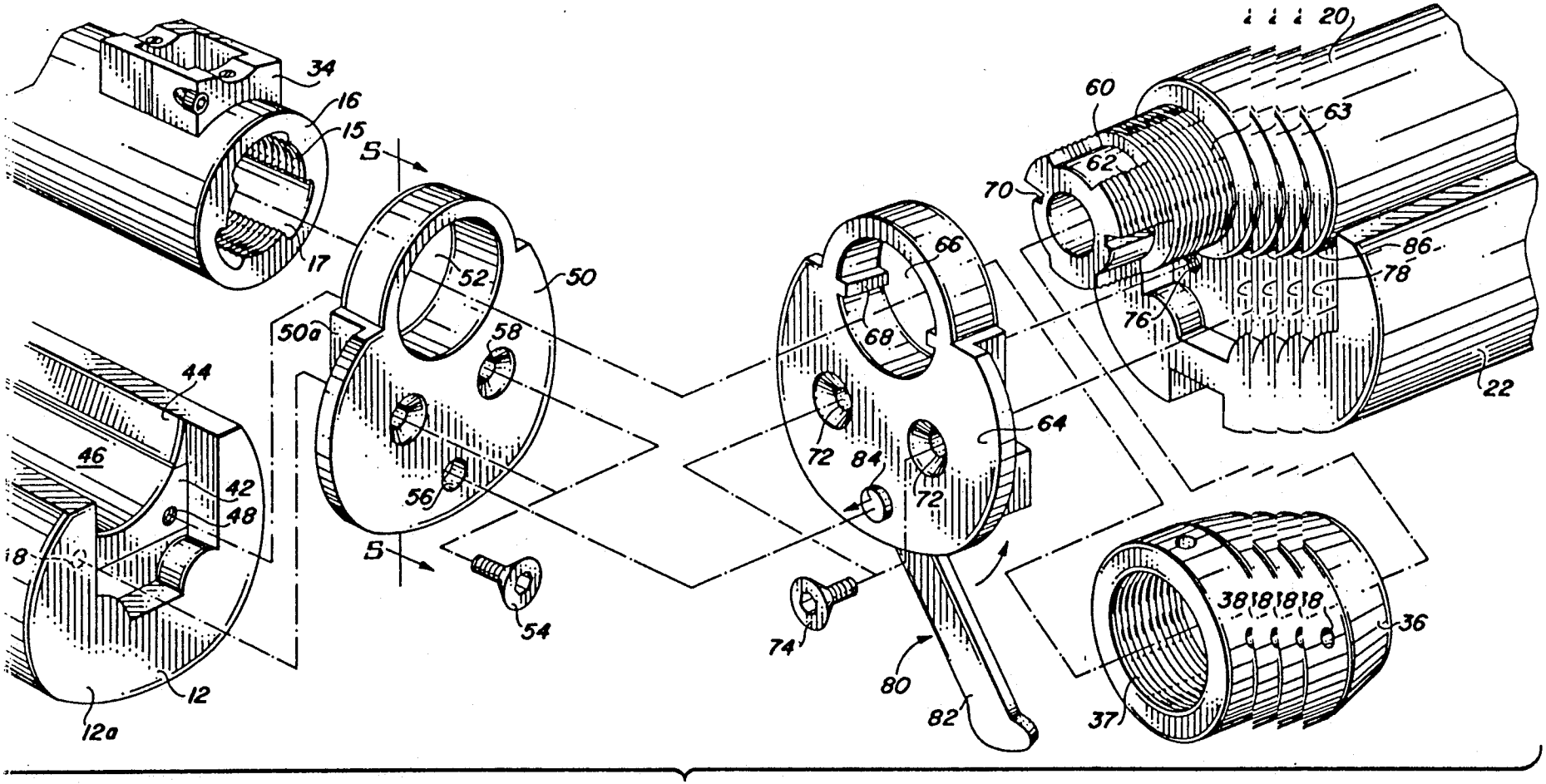
FIG. 4 is an exploded perspective view of the area designated "2" of FIG. 1.

As shown best in FIG. 4, which is an exploded perspective view of the area of the rifle designated by the numeral 2 of FIG. 1 and shown in enlarged perspective view in FIG. 2, the stock 12 is hollowed out and this hollowed out portion is provided with a bedding block 42 mounted into the hollowed out portion of the stock. Bedding block 42 is preferably fabricated from metal such as aluminum and is machined to provide a curved surface 46 with upper sides 44 being relatively flat and angled. Surfaces 46 and 44 of the bedding block are designed to receive a portion of the barrel action or receiver 16. In mounting the receiver into the bedding block it is preferred that the receiver contact the bedding block basically at three points—in the center of the curved surface 46 and at each angles side 44. Although not shown, the receiver is securely fastened to the bedding block by means of mechanical fasteners such as screws as is well known. In a most preferred embodiment, stock 12 is fabricated from a non-wood material such as a molded composite employing synthetic fibers of Kevlar, graphite and fiberglass or structural polyurethane foams and utilizing epoxy or polyester based resins as the bonding agent. In such an embodiment, the bedding block can be molded directly into the stock.

Figure 5:
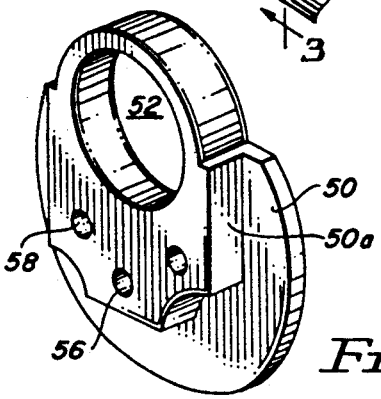
FIG. 5 is a view taken on the line 5—5 of FIG. 4 and showing the receiver bracket.

The forward end of stock 12 is designed to receive metal receiver bracket 50 which bracket is also shown in FIG. 5. The outer edges of receiver bracket 50 are shaped or machined to conform to the exterior shape of the forward end of stock 12 and receiver 16. Receiver bracket 50 is provided with opening 52 which is in alignment with opening 17 at the front end of the receiver. Receiver bracket 50 is also provided with openings 58 in alignment with threaded holes 48 of the bedding block. As shown, the forward end of bedding block 42 is positioned a small distance back of the front surface 12*a* of the stock so that the stock may accommodate the portion 50*a* of the receiver bracket 50.

The receiver bracket is secured to the front end of stock 12 and specifically to the bedding block by means of fasteners 54 which are screwed into threaded holes 48 of the bedding block.

Figure 3:
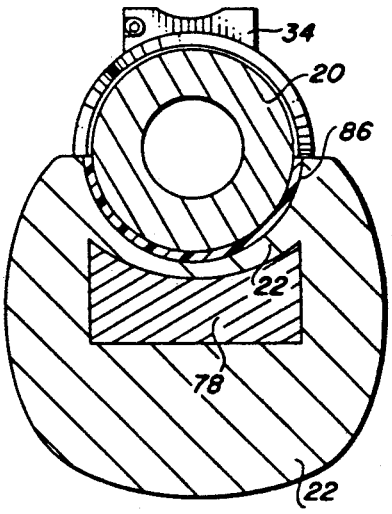
FIG. 3 is a section taken on the line 3—3 of FIG. 2.

As best shown in FIGS. 3 and 4, forearm 22 is provided with a reinforcing and mounting member 78 which can be secured into the forearm in much the same manner as is done with bedding block 42 in the stock. Reinforcing member 78 is made of metal, preferably aluminum to save weight and extends throughout substantially the entire length of the forearm. Member 78 should be securely mounted in the forearm and although mechanical fasteners may be used, it is preferable that the forearm be formed of a molded composite of the type as used in the stock with reinforcing member 78 molded into the forearm to give maximum stiffness and strength. As shown, reinforcing member 78 is provided with threaded openings 76 for attachment of barrel bracket 64 and the member is recessed into the forearm a distance to accommodate the barrel bracket 64.

Barrel 20 is mounted into the forearm 22, and, as shown in FIGS. 3 and 4 the barrel is not mechanically fastened to the forearm but is adhesively secured to the forearm. As is shown best in FIG. 3, a layer of flexible elastomeric adhesive 86 is provided between the upper surface of the forearm and the barrel which secures the barrel to the forearm. The type of flexible elastomeric adhesive employed is critical in that the adhesive must be a type that will not only bond the barrel to the forearm in a permanent manner, but will also allow for very slight movement of the barrel of perhaps up to about 0.005 inches during the adjusting process and also be noncorrosive. Thus, the elastomeric adhesive should have a durometer reading ranging from $H_A15$–$H_A90$ according to the ASTM (American Society for Testing and Materials) durometer hardness test designated D2240-86 utilizing a type A durometer. Preferably, the durometer reading of the adhesive should range from about $H_A30$–$H_A50$ where $H_A$ designates the hardness reading on a type A durometer. Examples of such elastomeric adhesives include those formed from silicones, polyurethanes, polysulphones or flexible epoxy resins. An example of a specific adhesive which works well is a silicone based adhesive available from Dow Corning Company and called Dow Corning 3145 RTV, a non corrosive room temperature curing silicone rubber.

In adhesively securing the barrel to the forearm the following steps should be observed.

1. The mating surfaces of both the barrel and forearm should be clean and dry.
2. A primer* is applied to both surfaces and allowed to dry for a period of about 2 hours.

* Available as Dow Corning 1204 Prime Coat

3. Adhesive is applied to both surfaces and barrel is assembled to the forearm.
4. The entire rifle is then completely assembled prior to curing of the adhesive.
5. The adhesive is tack free at about 2 hours and fully cured at 72 hours.

Barrel bracket 64 is quite similar in construction to receiver bracket 50 and the outer edges of the barrel bracket are shaped or machined to generally conform to the exterior shape of the barrel/forearm portion of the rifle. Barrel bracket 64 is provided with opening 66 which receives a portion of threaded tenon 60 of the barrel 20. To prevent undesirable movement between the barrel and forearm during assembly or disassembly of the rifle, the opening 66 of the barrel bracket is also provided with keys 68 which align with keyways 70 of the threaded barrel tenon. This type of construction insures that the barrel and forearm turn as a unit during assembly or disassembly of the rifle. Barrel bracket 64 is secured to reinforcing member 78 of the forearm by means of threaded fasteners 74 which are inserted through openings 72 in the bracket and into the threaded openings 76 of member 78.

Bracket 78 is also provided with a locking lever system 80 having a lever arm 82 and alignment pin 84. Moving lever arm 82 in a direction either towards or away from the forearm 22 causes alignment pin 84 to move in a direction to or away from the forearm. In an assembled rifle, alignment pin 84 fits into opening 56 of the receiver bracket.

As previously noted, the system for accommodating for thread wear includes an adjusting collar which is threaded on the receiver end of the barrel. As shown in FIGS. 2 and 4, adjusting collar 36 is provided with continuous threads 37 which allows collar 36 to be screwed onto threaded portion 63 of barrel tenon 60. Collar 36 is also provided with depressions 38 on its outer surface to accommodate spanner wrench 40.

Assembly of the barrel end of the rifle including forearm to the receiver end of the rifle is as follows. The receiver bracket 50 has been previously secured to bedding block 42 and barrel bracket 64 has been previously secured to reinforcing member 78 and forearm 22, and collar 36 has been screwed on to threaded portions 63 of barrel tenon 60. As shown in FIG. 4, the end portion of barrel tenon 60 is provided with interrupted threads 62 and, as shown, there are three such sets of interrupted threads. Interior 17 of receiver !6 also has three sets of interrupted threads 15. The portion of barrel tenon 60 with the interrupted threads is placed into the interior 17 of receiver 16 and then the forearm and barrel assembly is turned until the end of the barrel tenon is fully inserted into the receiver 16. At this point the adjacent surfaces of the barrel and receiver brackets will be in contact.

Locking lever 82 is then closed by moving it toward the forearm which causes alignment pin 84 to move into opening 56 of receiver bracket and securely lock and aligh the rifle's two major components together.

The need to adjust for thread wear will be apparent when the two sections of the rifle are screwed together. If one is able to turn the forearm section of the rifle beyond the point where the alignment pin goes into the receiver bracket, then it is likely that adjustment for wear is in order.

Adjustment is accomplished as follows. The two major components are taken apart and adjusting collar 36 is turned in a clockwise direction as shown by the arrow 39 in FIG. 2 by use of spanner wrench 40. Adjusting collar 36 of course bears on barrel bracket 64 which is rigidly secured to reinforcing member 78 of the forearm 22. The barrel bracket therefore does not move so that any force which is brought to bear by turning the adjusting collar against the barrel bracket causes the barrel to move in a direction away from the barrel bracket 64 as shown by the directional arrow 79 in FIG. 2. This movement of the barrel with respect to the forearm is possible because the barrel is adhesively secured to the forearm as previously described.

The need for adjustment depends primarily on the number of times that the rifle has been assembled and reassembled which bears on the amount of thread wear. Certainly, adjustment is not necessary every time the rifle is disassembled and reassembled. It has been found that the amount of barrel movement required for proper adjustment is ordinarily in the range of 0.001 or 0.002 inches. However, it has also been found that barrel movement of up to 0.005 inches is possible.

What is claimed is:

1. A take-down rifle having a stock and receiver secured together as a first unit and a forearm and barrel secured together as a second unit, with the receiver end of said barrel provided with means which engage with said receiver for securing said first and second units together as an assembled rifle, a reinforcing member mounted in said forearm, with said barrel being bonded to said forearm by means of an elastomeric adhesive, a barrel bracket mounted to the receiver end of said forearm and secured to said reinforcing member in said forearm with a portion of said bracket surrounding the receiver end of said barrel, and an adjusting collar positioned about the receiver end of said barrel and in contact with said barrel bracket and said barrel, whereby moving said adjusting collar in a direction toward said barrel bracket will cause said barrel to move in a direction away from said barrel bracket and said receiver end of said rifle to thereby compensate for wear in said means for securing said first and second units together as an assembled rifle.

2. The rifle of claim 1 wherein said elastomeric adhesive has a durometer reading ranging from about $H_A$1-5-$H_A$90 utilizing a type A durometer.

3. The rifle of claim 2 wherein said reinforcing member is metal.

4. The rifle of claim 3 wherein said forearm is made of a non-wood material.

5. The rifle of claim 4 wherein said forearm is made of a molded composite employing synthetic fibers.

6. The rifle of claim 5 wherein said elastomeric adhesive is a flexible elastomeric adhesive having a durometer reading ranging from about $H_A$30–$H_A$50 utilizing a type A durometer.

7. The rifle of claim 6 wherein said elastomeric adhesive includes those formed of silicones, polyurethanes, polysulfones and epoxy resins.

8. The rifle of claim 6 wherein said means which engage with said receiver for securing said first and second units together as an assembled rifle includes a threaded tenon on the receiver end of said barrel, a portion of which engages with a threaded opening in said receiver.

9. The rifle of claim 8 wherein said adjusting collar is positioned on said threaded tenon of said barrel.

10. The rifle of claim 9 wherein a receiver bracket is mounted to said barrel end of said stock and engages the barrel end of said receiver and wherein in an assembled rifle said receiver bracket and said barrel bracket are in contact.

11. The rifle of claim 10 wherein locking and alignment means are provided in said barrel bracket which engage with said receiver bracket.

12. The rifle of claim 11 wherein said stock is provided with a bedding block and wherein said receiver is secured to said bedding block.

13. The rifle of claim 12 wherein said receiver bracket is secured to said bedding block.

* * * * *